United States Patent [19]

Uchida

[11] 4,026,194

[45] May 31, 1977

[54] REMOTE CONTROL SYSTEM CONTROLLED BY A FLUID PRESSURE

[75] Inventor: Hiroshi Uchida, Tokyo, Japan

[73] Assignee: K.K. Uchida Sangyo, Tokyo, Japan

[22] Filed: Oct. 28, 1975

[21] Appl. No.: 626,079

[30] Foreign Application Priority Data

Nov. 1, 1974 Japan ..... 49-126327
Dec. 10, 1974 Japan ..... 49-142377

[52] U.S. Cl. ..... 91/384; 91/461
[51] Int. Cl.² ..... F15B 9/10
[58] Field of Search ..... 91/384, 461, 365, 378

[56] References Cited

UNITED STATES PATENTS 3,093,121 6/1963 Murphy ..... 91/384
3,272,062 9/1966 Flippo et al. ..... 91/384
3,433,128 3/1969 Hayner et al. ..... 91/384

*Primary Examiner*—Paul E. Maslousky
*Attorney, Agent, or Firm*—Spensley, Horn & Lubitz

[57] ABSTRACT

A remote control system controlled by fluid pressure in which a master and a slave each having a mechanical position feedback mechanism therein are installed in spaced position from each other and connected via only a pilot fluid pipe to form an open loop control system as a whole. A control rod in the master can be moved by a small force independently of the magnitude of a load applied to the slave and an actuating piston in the slave is positioned in accordance with the amount of movement of the control rod in the master.

4 Claims, 5 Drawing Figures

REMOTE CONTROL SYSTEM CONTROLLED BY A FLUID PRESSURE

BACKGROUND OF THE INVENTION

The present invention relates to a remote control system controlled by fluid pressure.

When handling a heavy article or an instrument installed in an environment which human beings can not withstand, a remote control system is often employed to handle the article or the instrument. The remote control system generally has a master operated by an operator and a slave controlled by the master.

In such a remote control system it is important to position or to move the article or the instrument precisely. Therefore, many of the known remote control system is provided with electrohydraulic servo mechanisms and electrical detecting devices therein, thereby detecting an amount of handling at the slave of the system to feedback a signal representing the amounts to the master. Disadvantages in the known remote control system is that it is impossible to employ the system in an explosive environment because of dangerousness of sparking discharged from the electrohydraulic servomechanism and the electrical detecting device, and in addition, it is expensive due to its complexity in construction.

accordingly it is an object of the present invention to provide a remote control system of simple construction and of being usable in an explosive environment.

SUMMARY OF THE INVENTION

The present invention relates to a remote control system comprising a master having a mechanical position feedback mechanism therein and a slave also having a mechanical position feedback mechanism therein. The master and the slave form an open loop control system having no feedback but mechanical feedback is effected in each of the master and the slave by its mechanical position feedback mechanism.

Connected to the master is a first pressurized fluid source which supplies a pilot fluid to the slave, to which a second pressurized fluid source for actuating a load is connected. The master and the slave are connected via only a pair of pilot fluid pipes and they are located at distant places from each other.

According to a first embodiment of the present invention, the master comprises a control rod adapted to be operated by an operator, a first pilot spool arranged in parallel to said control rod, a first feedback link connecting said control rod to said first pilot spool, a first servo spool which engages an intermediate portion of said feedback link, and a coil spring for urging said first pilot spool to a connecting point of said first pilot spool and said feedback link. When the control rod is moved axially by the operator, the first servo spool is moved in the same direction as the control rod. As the first servo spool is moved from its neutral position, pressurized fluid from the first pressurized fluid source connected to the master flows into the master and it is fed to the slave with a pressure determined by an axial stationary position of the first pilot spool.

The slave in the first embodiment of the present invention comprises a second pilot spool a stationary position of which is determined by the magnitude of a pilot fluid pressure from the master, an actuating piston arranged in parallel to said second pilot spool, a second feedback link connecting said second pilot spool to said actuating piston, and a second servo spool which engages an intermediate portion of said feedback link.

Said second pilot spool is moved axially in response to a pilot fluid pressure supplied from said master, and said second servo spool is moved from its neutral position in the same direction as said second pilot spool is moved.

As the second servo spool is moved from its neutral position, a pressurized fluid from said second pressurized fluid source flows into a cylinder into which the actuating piston is inserted so that the actuating piston is moved. The movement of the actuating piston is transmitted to the second feedback link, whereby the second servo spool is restored to its original neutral position. After the actuating piston is moved in accordance with the pilot fluid pressure transmitted from the master to the slave, and it is stopped at the shifted position.

In a second embodiment of the present invention, the master is generally identical to the construction in the first embodiment but the slave is constructed to advantageously impart a rotational movement to a load to be handled. More particularly, the slave in the second embodiment is provided with a rack rod instead of the actuating piston, and a two-wing rotor having a pinion which is adapted to mesh with said rack rod. A rotor casing receiving said two-wing rotor is formed with a fluid passage communicating to a bore into which said second servo spool is inserted. A high pressure fluid is introduced from said second fluid source to said casing through said second servo spool. An actuating shaft connected to the load is fixed to the two-wing rotor and it is rotated with the rotation of the two-wing rotor. The rotational angles of th two-wing rotor and the actuating shaft depend on the amount of axial movement of the rack rod, which in turn is proportional to the amount of axial movement of said second pilot spool. Accordingly, the rotational angle of the actuating shaft is proportional to the amount of axial manipulation of the control rod in the master.

A feature of the present invention resides in that the master and the slave each located at distant places from each other include no electrically operated parts, and the manipulation amount in the slave can be changed in any way in accordance with a pilot fluid pressure generated at the master, the master and the slave each includes an independent closed loop control system based on the mechanical position feedback system, and on the other hand, the entire system forms an open loop control system havng no feedback. Therefore, the remote control system of the present invention offers an advantage in that it is simple in construction and hence less expensive in comparison with a known remote control system or remote manipulator system which includes an expensive electrohydraulic servo mechanism, and it can be safely used even in an explosive environment or a high temperature or other severe environments.

DETAILED DESCRIPTION OF THE PREFERRED EMBODIMENTS

Figure 1:
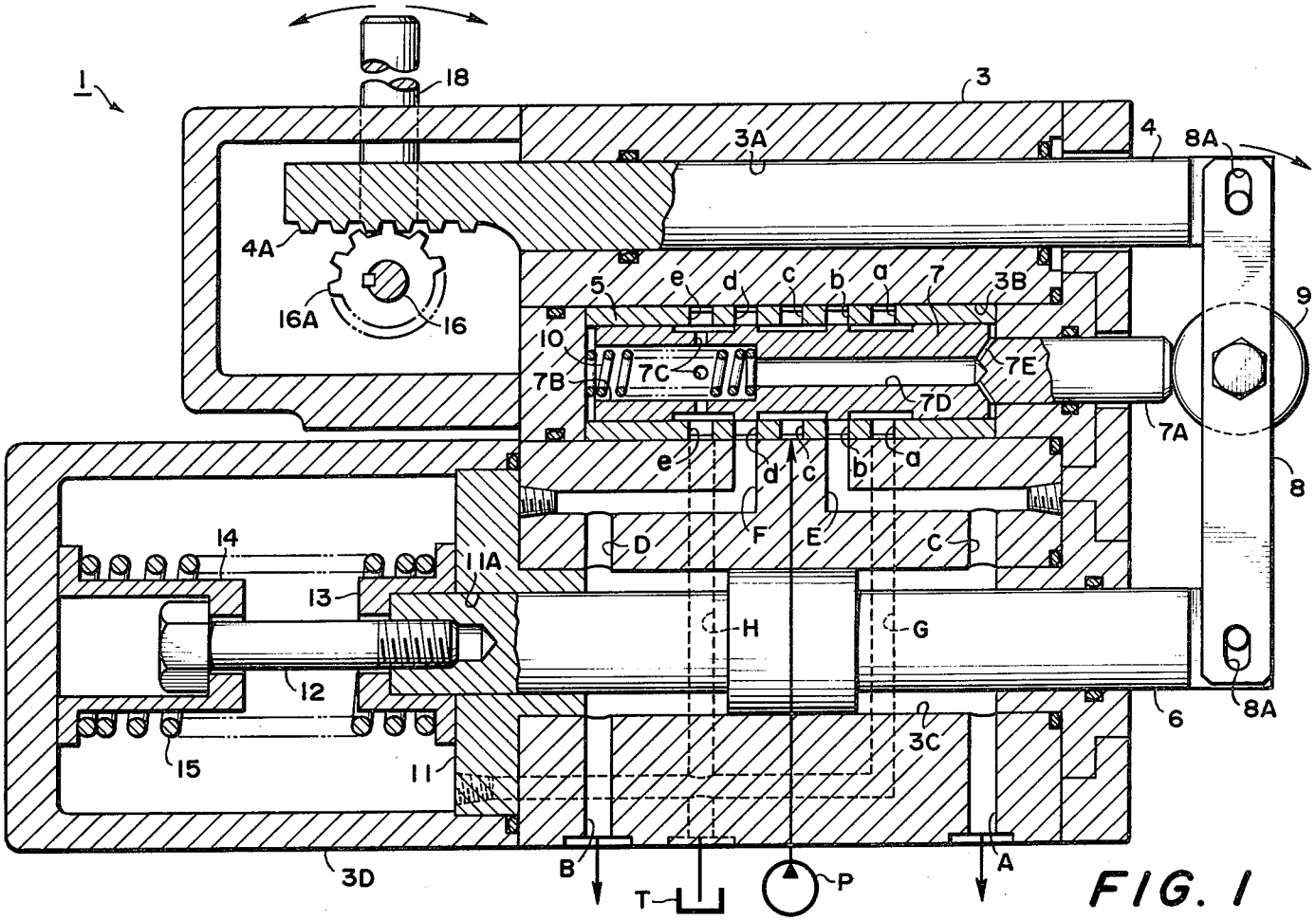
FIG. 1 is a longitudinal sectional view of a master of a remote control system of the present invention.
Figure 2:
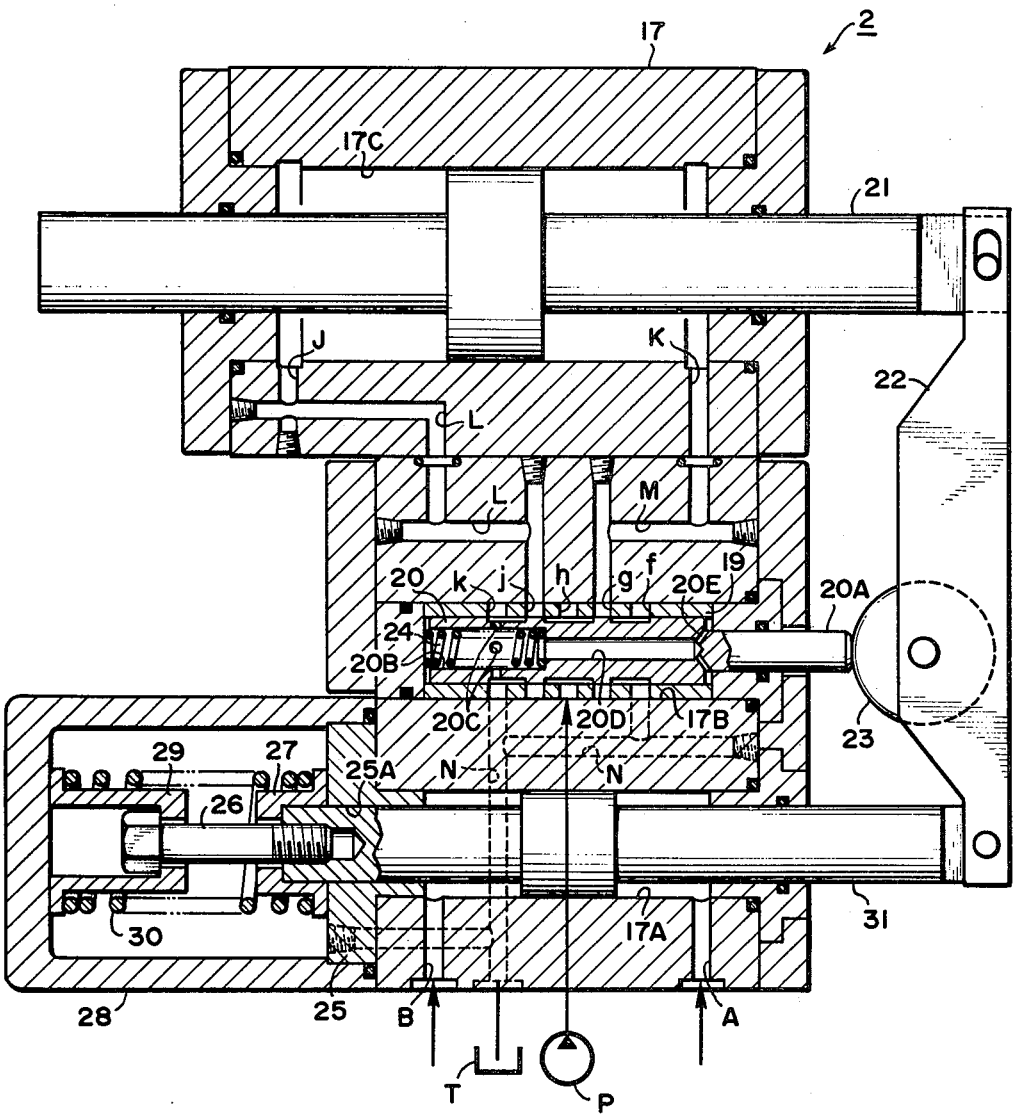
FIG. 2 is a longitudinal sectional view of a first embodiment of a slave of the present remote control system.

The present system consists of a master 1 shown in FIG. 1 and a slave 2 shown in FIG. 2. The master shown in FIG. 1 will first be described below.

Referring to FIG. 1, the master 1 includes a body 3 having three parallel axial bores 3A, 3B and 3C. A control rod 4 having a rack 4A at one end thereof is slidably inserted into the first axial bore 3A. The second bore 3B receives a sleeve 5 having ports *a* through *e* extending perpendicularly to the axis thereof. A first pilot spool 6 having a central enlarged portion is slidably inserted into the third bore or cylinder 3C.

A first servo spool 7 having three circumferential grooves formed thereon is slidably inserted into the sleeve, and one end 7A thereof has a reduced diameter and projects outwardly from the body 3.

The other end of the control rod 4 projects outwardly from the body 3 in the same direction as the end 7A of the first servo spool 17, and the projected end thereof is pivotably connected to one end of a feedback link 8 which extends perpendicularly to the axis of the control rod 4. The other end of the feedback link 8 is pivotably connected to the end of the first pilot spool 6 projected from the body 3. The end 7A of the first servo spool 7 engages with a middle portion of the feedback link 8 through a roller 9 mounted on the feedback link 8.

The first servo spool 7 has generally a cylindrical form and has a cylindrical space 7B at the opposite end to the end 7A. A coil spring 10 received in the space 7B urges the first servo spool 7 toward the right in FIG. 1. A space 7B in which the coil spring 10 is received communicates with the port *e* of the sleeve 5 through several communicating ports 7C formed peripherally of the first servo spool 7. The space 7B also communicates with a space within the sleeve 5 through an axial bore 7D and a passage 7E.

Opening into the third bore 3C or cylinder in which the first pilot spool 6 is mounted, are output ports A and B at opposite ends, and input ports C and D are also formed at positions facing to the output ports A and B respectively. The input ports C and D respectively communicate with the ports *b* and *d* of the sleeve 5 through passages E and F formed in the body 3. Of the five ports *a* through *e* formed in the sleeve 5, the ports *a* and *e* are communicated to a tank T or atmosphere through respective passage G and H, and the port *c* is connected to a pressurized fluid source P.

A plug 11 closes the one end (left hand end in FIG. 1) of the bore 3C includes a throughhole 11A through which the first pilot spool 6 is slidably inserted. At the end of the first pilot spool projected outwardly from the cylinder 3C through the through-hole 11A, a bolt 12 is threadably mounted and a cap-shaped spring seat 13 is slidably fitted relative to the first pilot spool.

Fitted onto the outer periphery of the plug 11 is a cylindrical cover 3D into which the first pilot spool 6 extends. Another cap-shaped spring seat 14 slidably fitted onto the head of the bolt 12 abuts against the inner end surface of the cover 3D. Mounted between the two spring seats 13 and 14 is a coil spring 15, which, when the first pilot spool is moved to the left in FIG. 1, is compressed by the spring seat 13 which moves with the first pilot spool 6.

The rack 4A formed at one end of the control rod 4 meshes with a pinion 16A fixed to a shaft 16 which in turn is fixed to a lever 18 rockably about the axis of the shaft 16.

At opposite ends of the feedback link 8 slots 8A are formed at connecting points of the control rod 4 and the first pilot spool 6. The slot 8A allows the feedback link 8 to swing about the axis of the roller 9 and the connecting portion of the feedback link 8.

The operation of the master of the above construction is now described.

When the lever 18 is rotated clockwise in FIG. 1, the control rod 4 is moved axially to the right in FIG. 1 and as a result the feedback link 8 is swung about the connecting point of the first pilot spool 6 in the direction of an arrow in FIG. 1. As the feedback link 8 is swung clockwise, the roller 9 mounted on the feedback link 8 is also shifted to the right in FIG. 1 and the first servo spool 7 which is constantly urged the roller 9 by the spring 10 to the right in FIG. 1, is also moved axially to the right in FIG. 1. As a result, relative positional relation between the sleeve 5 and the first servo spool 7 changes such that the port *b* which heretofore has been blocked from communication with other ports by a land of the first servo spool at a neutral position, now communicates with the port *c* through the groove on the peripheral surface of the servo spool 7, and the port *d* communicates with the port *e*. Then, pressurized fluid from the pressurized fluid source P through the passage E into a space right-hand of the bore 3C, and thence passes through the output port A to the slave 2 to be described later. In this instance, since a left-hand space of the bore 3C communicates with the tank T or the atmosphere through the passage F, ports *e* and *d*, and passage H, the first pilot spool is moved to the left in FIG. 1.

When the pressurized fluid transmitted to the slave 2 from the output A reaches a pressure which is sufficient to actuate the slave 2, the first pilot spool 6 is moved to the left in FIG. 1 by a corresponding amount so that the spring seat 13 is also moved to the left to compress the coil spring 16.

When the first pilot spool 6 is moved to the left in FIG. 1, the servo spool 7 is also pushed back to the left through the feedback link 8 and roller 9 so that the servo spool 7 restores the neutral position as shown in FIG. 1. As a result, the ports *b* and *c*, which hertofore have been in communication each other, are now blocked and the communication between the ports *d* and *e* is also blocked and hence the flow of the fluid from the pressurized fluid source P to the right-hand space of the bore 3C is blocked. (In this instance, the pressurized fluid which has been fed to the slave 2 through the right-hand space of the bore 3C reaches a pressure which is proportional to the contracted amount of the coil spring 15.)

In the above instance, if the amount of movement of the first pilot spool 6 is too large, the servo spool 7 is moved beyond the neutral position relative to the sleeve 5 further to the left so that the port *c* communicates with the port *d* and the pressurized fluid from the pressurized fluid source P flows into the left-hand space of the bore 3C to push the first pilot spool 6 back to the right from the over-centered position. As a result, the roller 9 is also returned to the right with the feedback link 8 and the servo spool 7 is returned to the neutral position. In this manner, in the master 1, since the axial position of the first pilot spool 6 is mechanically fed back to the servo spool 7 through the feedback link 8, the amount of movement of the control rod 4 is converted to the amount of movement of the first pilot spool 6.

On the other hand, when the lever 18 is rotated in counterclockwise direction in FIG. 1, the control rod 4 is moved to the left in FIG. 1, and the servo spool 7 is moved to the left through the feedback line 8 and roller 9 so that the port *c* communicates with the port *d*. As a result, the first pilot spool 6 is moved to the right in FIG. 1 and the left-hand spring seat 14 is moved to the right through the bolt 12 fixed to the first pilot spool 6 so that the coil spring 15 is compressed.

The above rightward movement of the first pilot spool 6 causes the roller 9 to move to the right through the feedback link 8, and as a result the servo spool 7 follows the movement of the first pilot spool 6 to move to the right so that the communication between the port *c* and the port *d* is blocked and the flow of the pressurized fluid from the pressurized fluid source P to the left-hand space of the bore 3C is stopped. Again, in this case, the pressure of the fluid supplied to the slave 2 from the left-hand space of the bore 3C through the output port B is proportional to the amount of compression of the coil spring 15, like in the previous case. (In this instance, the movement of the first pilot spool 6 is fed back to the servo spool 7 through the feedback link 8, like in the previous case.)

As described above, a fluid whose pressure is proportional to the amount of rotational movement of the lever 18 is supplied from the master 1 to the slave 2 to be described later.

It will be readily understood from the above description that the feedback link 8 serves to feedback mechanically the postion of the first pilot spool 6 to the first servo spool 7.

The construction of the slave 2 used with the master shown in FIG. 1 is now described with reference to FIG. 2.

Like the master 1, the slave 2 includes a body 17 having three parallel axial bores 17A, 17B and 17C. In the axial bore or cylinder 17A a second pilot spool 31 of the same structure as the first pilot spool 6 in the master 1 is slidably inserted; in the axial bore 17B, a sleeve 19 having five ports, like in the case of the master 1, is fitted; and in the axial bore 17C an actuating piston 21 is slidably inserted.

A second hollow servo spool 20 having three grooves thereon corresponding to the ports *f*, *g*, *h*, *j*, *k*, of the sleeve is slidably inserted into the sleeve 19. One end 20A of he second servo spool 20 has a reduced diameter and projects outwardly from the body 17. One end of the second pilot spool 31 projects from the body 17 in the same direction as the projecting end 20A of the second servo sool 20, and the projecting end of the second pilot spool 31 is pivotably connected to one end of a feedback link 22 extending perpendicularly to the axis of the second pilot spool 31 and second servo spool 20 and actuating piston 21. The other end of the feedback link 11 is pivotably connected to the end of the actuating piston 21 which projects from the body 17, and engages the projecting end 20A of the second servo spool 20 through a roller 23 mounted at an intermediate portion thereof.

The second servo spool 20 is constructed in generally hollow structure except for its projecting end 20A having a reduced diameter, and is formed a cylindrical space 20B at the opposite end thereof. A space 20B into which the coil spring 24 is inserted communicates with the port *k* of the sleeve 19 through several communicating ports formed on a peripheral wall surface of the second servo spool 20. The space 20B also communicates with a space within the sleeve 19 through an axial bore 20D and passage 20E of the second servo spool 20.

The coil spring 24 inserted into the space 20B urges the spool 20 to the right in FIG. 2.

Opening to the bore or cylinder 17C into which the actuating piston 21 is inserted are input ports J and K which respectively communicate with the ports *j* and *g* of the sleeve 18 through passage L and M. Of the five ports *f*, *g*, *h*, *j*, *k* formed in the sleeve 19, the ports *f* and *k* communicate with the tank T or atmosphere through a passage N, and the port *h* connected to a pressurized fluid source such as a pump P.

One end of the bore 17A which the second pilot spool 31 is inserted (the left-hand end in FIG. 2) is closed by a plug 25 havng a through-hole 25A, and at the end of the second pilot spool 31 which projects outwardly from the body through the through-hole 25A a bolt 26 is threadably connected and a cap-shaped spring seat 27 is slidably fitted on the end of the second pilot spool 31.

Fixed onto the outer periphery of the plug 25 is a cylindrical cover 28 into which extends axially of the second pilot spool 31, and another spring seat 29 into which a head of the bolt 26 is inserted abuts against the inner end surface of the cover 28. Between those spring seats 27 and 29, a coil spring 30 is disposed, which, when the second pilot spool 31 is moved to the left in FIG. 2, is compressed by the spring seat 27 which is moved with the second pilot spool 31, and when the second pilot spool 31 is moved to the right in FIG. 2 the coil spring 30 is compressed by the other spring seat 29 which is moved to the right with the bolt 26.

In the construction of the slave above described, the feedback link 22 forms a mechanical position feedback mechanism for feedbacking the position of the second pilot spool 31 to the second servo spool 20.

The operation of the slave of the above construction is now described below.

When pressurized fluid at any pressure supplied from the master 1 flows from the input port A into the bore 17A into which the second pilot spool 31 is inserted, the second pilot spool 31 is moved to the left in FIG. 2 and the coil spring 30 is compressed by the spring seat 27 which is moved with the second pilot spool 31. Then, the second servo spool 20 is also moved to the left in FIG. 2 through the feedback link 22 connected to the second pilot spool 31 so that the port *h* communicates with the port *j* to allow the pressurized fluid from the pressurized fluid source P to flow into the left-hand space of the bore 17C, and the port *f* communicates with the port *g* to allow the right-hand space of the bore or cylinder 17C to communicate with the tank T or atmosphere. As a result, the actuating piston 21 is moved to the right in FIG. 2., Since the spring force of the coil spring 30 which is compressed by the leftward movement of the second pilot spool 31 causes to stop the second pilot spool 31 at a position at which it balances with the fluid pressure supplied to the bore 17A (the rest position of the second pilot spool 31 being determined by the magnitude of the pilot fluid pressure supplied from the master 1 to the slave 2), the pivot point of the second pilot spool 31 and feedback link 22 stops at a predetermined position.

As the actuating piston 21 moves to the right in the manner described above, the roller 23 also moves to the right in FIG. 2 through the feedback link 22, and the second servo spool 20 which has once moved to the left is returned to the right by the action of the spring 24 so that the communication between the ports *h* and *j* is blocked and the supply of the pressurized fluid from the pressurized fluid source P to the bore 17C through the passages L and J is stopped. In this case, the load applied to the actuating piston 21 balances with total pressure acting on the piston 21. As the load increases the actuating piston 21 moves to the left in FIG. 2 and this movement causes the leftward movement of the second servo spool 20 in FIG. 2 through the feedback link 22. As a result, the port *h* communicates with the port *j* and the amount of fluid supplied to the left-hand space of the bore 17C from the pressurized fluid source P increases so that the pressure applied to the piston 21 balances with the load. On the other hand, the movement of the actuating piston 21 is also transmitted to the second pilot spool 31 through the feedback link 22 and the second pilot spool 31 is also moved to the left. That is, the change in the axial position of the actuating piston 21 is also fed back to the second servo spool 20 and the second pilot spool 31. Similarly, when the pressurized fluid at any pressure supplied from the output port B of the master 1 flows into the input port B in the slave 2, the pilot spool 31 is moved to the right in FIG. 2, and as a result the spring seat 29 is also moved to the right in FIG. 2 with the bolt 26 fixed to the second pilot spool 31 so that the coil spring 30 is compressed. Accordingly, the leftward force acts on the second pilot spool 31 through the spring seat 29 and bolt 26 in FIG. 2.

As the second pilot spool 31 is moved to the right, the roller 23 attached to the feedback link 22 is also moved to the right and the second servo spool 20 is also moved to the right in FIG. 2 to follow the movement of the roller 23 so that the port *h* communicates with the port *g* and the pressurized fluid from the pressurized fluid source P flows into the right-hand space of the bore 17C through the passage M. As a result, the actuating piston 21 is moved to the left in FIG. 2.

In the above case, since the position of the actuating piston 21 is determined in accordance with the position of the second pilot spool 31 (or the balancing position of the second pilot spool 31 is fed back through the feedback link 22 and the roller 23 to return the second servo spool 20 to the neutral position), the actuating piston 21 is moved in accordance with the fluid pressure supplied from the master 1.

While the present system has been described and shown in the above embodiment to be driven mainly by fluid pressure especially hydraulic pressure, it should be understood that the present system may be driven by pneumatic pressure, in which case bellows may be used instead of the piston or the spool.

Figure 3:
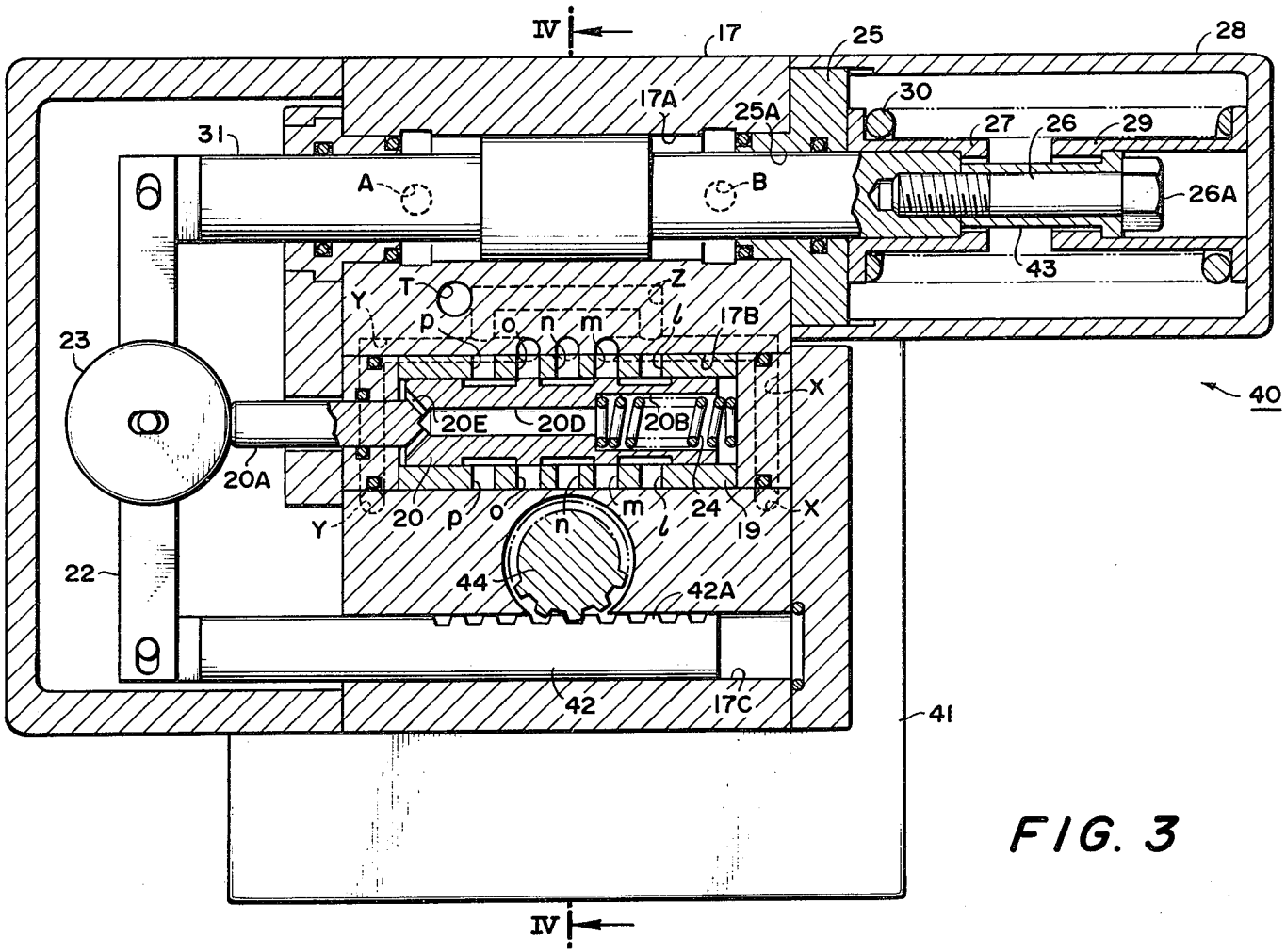
FIG. 3 is a longitudinal sectional view of a second embodiment of the slave of he present remote control system.
Figure 4:
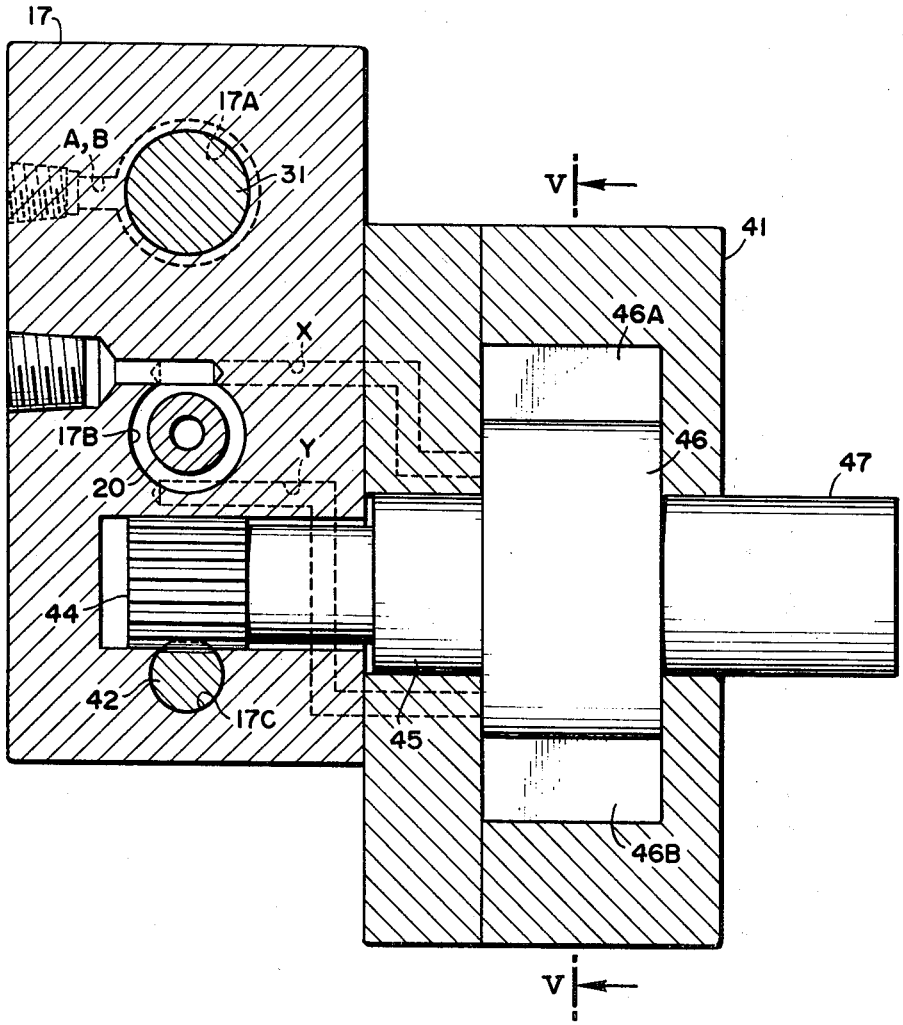
FIG. 4 is a sectional view taken along a line IV—IV of FIG. 3 in the direction of the arrow.
Figure 5:
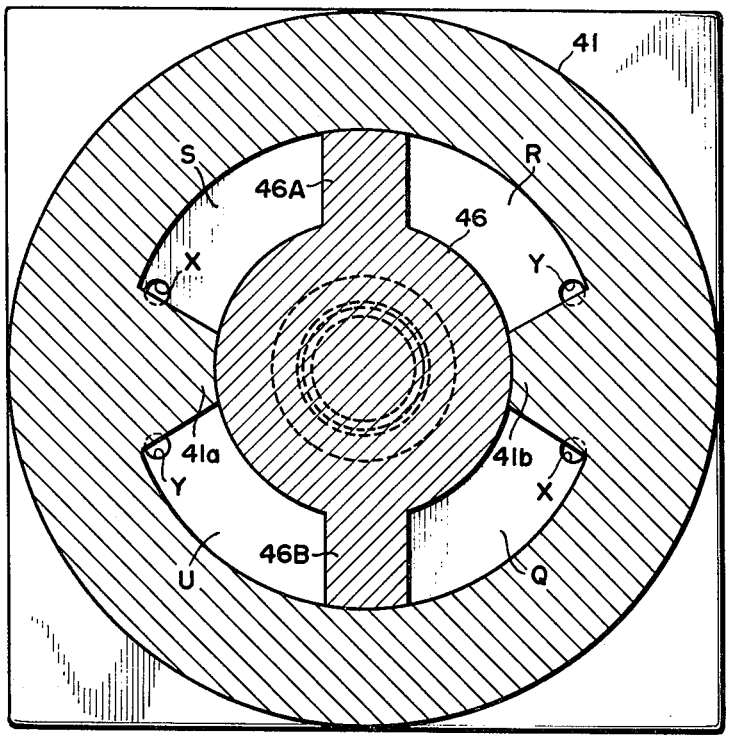
FIG. 5 is a sectional view taken along a line V—V of FIG. 4 in the direction of the arrow.

It is apparent that the slave can generate not only the axial movement but also the rotational movement by partially modifying the construction of the slave in FIG. 2. In FIGS. 3 through 5, a modification of the slave as a second embodiment of the present invention is shown. In the slave shown in FIGS. 3 through 5 the major construction is the same as the slave shown in FIG. 2 and hence those parts which are identical to those in FIG. 2 are represented by the same references.

As seen from FIGS. 3 and 4, a body of the slave in the second embodiment of the present invention comprises a generally parallel bored section 17 and a cylindrical section 41, the section 17 having three parallel bores 17A, 17B, 17C formed therein as shown in FIG. 3. In the bore 17A, a second pilot spool 31 is disposed to allow axial movement thereof; in the second bore 17B a sleeve 19 having ports *l*, *m*, *n*, *o*, *p* formed therein is disposed; and in the third bore 17C a rod 42 with a rack is disposed to allow axial movement thereof. The bore 17A into which the second pilot spool 31 is inserted functions as a cylinder for the second pilot spool 31, and opening to the bore 17A are input ports A and B for feeding fluids of various pressures to opposite ends of the second pilot spool 31. The input ports A and B are connnected to a remote installed master, not shown in FIG. 3, through a pilot pipe (not shown) so that pilot fluids of various pressures fed from the master are supplied thereto.

Opposite ends of the second pilot spool 31 project from the body 17, and one end thereof (the left-hand end thereof in FIG. 3) is pivotably connected through a pin to one end of a feedback link 22 which extends perpendicularly to the spool 31 (in vertical direction in FIG. 3). The other end of the feedback link 22 is pivotably connected through a pin to an end of the rod 42 having the rack projecting from the bore 17C. At the middle of the feedback link 22 a roller 23 is rotatably mounted, which roller 23 engages a projecting portion 20A of a second servo spool 20 which is inserted into the sleeve 19 to allow axial movement thereof. The second servo spool 20 is constructed in hollow cnstruction except for its projecting portion 20A, and a coil spring 24 is received in a hollow section 20B at the end opposite to the projecting portion 20A. One end of the coil spring 24 abuts against the inner surface of a plug which closes one end of the bore 17B, consequently the second servo spool 20 is urged leftwardly in FIG. 3 by the coil spring 24.

Of the five ports *l* through *p* formed in the sleeve 19, the ports *m* and *o* communicate through respective fluid passages X and Y with a chamber in the body 41 in which a two-wing rotor to be described later is accommodated, and the ports *l* and *p* are connected to a tank T through a fluid passage Z. The remaining port *n* is connected to a pressurized fluid source such as a pump.

The outer end of the second pilot spool 31 projects outwardly from the body 17 through a center throughhole 25A of a plug 25 which closes the end of the bore 17A, and in the projecting end of the second pilot spool 31 a cap-shaped spring seat 27 is fitted to allow relative axial movement thereof. At the projecting end of the second pilot spool 31 a bolt 26 is also screwed and a flanged sleeve 43 is fitted on the outer periphery of the bolt 26. A head 26A of the bolt 26 is inserted into another cap-shaped spring seat 29 which abuts against the inner surface of a cylindrical cover 28 fitted on the plug 25. Disposed between the two spring seats is a coil spring 30 which urges the spring seats 27 and 29 away from each other. By the coil spring 30 the spring seats 27 and 29 are urged to the plug 25 and the cover 28 respectively. When pressurized fluid at any pressure from the master in FIG. 1 is introduced into the bore or cylinder 17A through the ports A and B, the coil spring 30 causes the second pilot spool 31 to move to a position corresponding to the pressure of the pressurized fluid and causes the pressurized fluid to create a pressure corresponding to the amount of deflection of the coil spring 30.

Disposed between the second servo spool 20 and the rod 42 having the rack is a pinion 44 which meshes with a rack portion 42A of the rod 42. A shaft 45 carrying the pinion 44 extends in a direction perpendicular to the longitudinal direction of the rod 42 and into the second body 41.

The second body 41 is of cylinder shape as shown in FIGS. 4 and 5, and a space therein is divided into two chambers by a pair of projections 41*a* and 41*b* which project opposingly from the inner wall of the body 41. A two-wing rotor 46 is integrally formed on a shaft 45 which carries the pinion 44, as shown in FIG. 5, and rotor blades 46A and 46B each projects into different chamber to divide the space within the body 41 into four chambers R, S, U, Q. An actuating shaft 47 projects outwardly from the body 41 and extends from the other end surface of the rotor 46, and is connected to a shaft of a machine to be actuated.

The operation of the slave in FIGS. 3 through 5 will now be described.

When a pilot fluid of any pressure generated from the master shown in FIG. 1 is introduced into the bore 17A through the port B, the second pilot spool 31 is moved to the left in FIG. 3, and the feedback link 22 pivotably connected to the second pilot spool 31 is swung in counterclockwise direction in FIG. 3 about a connecting point of the rod 42 with the feedback link 22. As a result, the roller 23 mounted to the feedback link 22 is also moved to the left in FIG. 3 and the roller 23 tends to move away from the projecting portion 20A of the second servo spool 20. However, since the second servo spool 20 is being urged leftwardly by the coil spring 24, the second servo spool 20 follows the movement of the roller 23 to be moved to the left in FIG. 3. As a result, the port *o* which has been in blocked condition now communicates with the port *n*, and the port *m* communicates with the port *l*, and hence actuating fluid flows out of the pressurized fluid source (not shown) through the ports *n* and *o* and also flows into the chambers R and U in the body 41 through the fluid passage Y. On the other hand, because of the communication of the port *l* with the port *m*, the pressurized fluid in the chambers *o* and *s* in the body 41 is exhausted to the tank T through the fluid passage X so that no pressure exists in the chambers Q and S. Therefore, the rotor 46 and actuating shaft 47 are rotated in counterclockwise direction in FIG. 5.

In the above operation, the amount of axial movement of the second pilot spool 31 is determined in accordance with the pressure of the pilot fluid introduced into the cylinder 17A through the port B, and the second pilot spool 31 rests at a position corresponding to the pressure of the pilot fluid. That is, while the second pilot spool 31 is moved to the left in FIG. 3 by the fluid introduced into the cylinder 17A from the port B, the spring seat 29 is pulled to the left by the bolt 26 screwed at the projecting end of the second pilot spool 31, so that the coil spring 30 is compressed between the spring seats 27 and 29. The force exerted by the coil spring 30 urges the second pilot spool 31 to the right in FIG. 3 through the bolt 26. At the time when the force generated by the compression of the coil spring 30 balances with the pressure of the pilot fluid introduced into the cylinder 17A, the second pilot spool 31 is stopped so that the second pilot spool 31 rests at a position corresponding to the pressure of the pilot fluid. Accordingly, when the second pilot spool 31 stops, the position of connecting point of the second pilot spool 31 and the feedback link 22 remains stationary. Thus, even if the rotor 46 rotates beyond a predetermined rotational angle, the movement of the rotor 46 is fed back to the feedback link 22 through the pinion 44 and the rod 42 having the rack so that the axial position of the second servo spool 20 is changed to change the pressure of the fluid to the rotor 46.

When the pilot fluid is introduced into the cylinder 17A from the port A, the second pilot spool 31 is moved to the right in FIG. 3, as opposed to the previous case, and because of the compression of the coil spring 30 the second pilot spool 31 is exerted with a force to urge the second pilot spool 31 rightwardly in FIG. 3. As the second pilot spool 31 moves to the right, the roller 23 also moves to the right and the servo spool 20 also moves to the right. As a result, the port *o* in the sleeve 19 communicates with the port *p*, and the port *m* communicates with the port *n*. Thus, actuating fluid flows into the fluid passage *x* from the pressurized fluid source, not shown, through the ports *n* and *m* so that the actuating fluid is introduced into the chambers S and Q. At the same time, the actuating fluid in the chambers R and U is exhausted into the tank T through the fluid passage Y and the ports *o* and *p* so that no pressure exists in the chambers R and U. Thus, the rotor 46 is rotated in clockwise direction in FIG. 5, and the amount of rotation of the rotor 46 is fed back to the feedback link 22 through the pinion 44 and the rod 42. Accordingly, the amount of rotation of the rotor 46 is proportional to the pressure of the pilot fluid introduced into the cylinder 17A of the second pilot spool 31.

In the above construction, although the pressurized fluid source for supplying pressurized fluid to the master may be common to the pressurized fluid source for supplying pressurized fluid to the slave, it may be preferable that those two pressurized fluid sources have different capabilities when the load to be handled is very large.

Those shown in the accompanying drawings and the related description in the specification are merely illustrative of the present invention and it should be understood that various changes and modifications can be made within the scope of the appended claims and that the present invention is by no means limited to the illustrated particular embodiments.

What is claimed is:

1. A remote control system controlled by fluid pressure comprising:

a master, said master comprising:

a control rod operated by an operator to move axially a first pilot spool disposed parallel to said first control rod, a first cylinder receiving slideably said first pilot spool therein and communicating with a hydraulic pilot fluid source for supplying a pilot fluid, a first feedback link pivotably connected to said control rod at one end thereof and to said first pilot spool at the other end thereof and extending perpendicularly to the axis of said control rod and of the first pilot spool respectively, a first servo spool engaging with the middle portion of the first feedback link and controlling the supply of the pilot fluid into said first cylinder, a first means for urging said first pilot spool in a direction opposite to a direction of movement thereof, and a second means for urging said first servo spool toward the middle portion of said feedback link; and a slave coupled to said master by only a pair of pilot fluid pipes, said slave comprising:

a second pilot spool moved axially in accordance with the pressure of the pilot fluid from said first cylinder, a rod having a rack formed thereon and disposed parallel to said second pilot spool, a second feedback link pivotably connected to said second pilot spool at the one end thereof and to said rod at the other end thereof and extended perpendicular to the axis of said second pilot spool and of said rod respectively, a body having two chambers therein, communicating passages communicating said two chambers with an actuating fluid source for supplying and actuating fluid into said two chambers, a two wing rotor rotatably mounted in said body and being positioned one wing thereof in one of the chambers and the other wing thereof in another of the chambers, an actuating shaft connected bodily to said two win rotor, a pinion mounted on said actuating shaft and meshed with said rack formed on said rod a second servo spool engaging with middle portion of said second feedback link and controlling the supply of actuating fluid to said one of two chambers, a third means for urging said second pilot spool in a direction opposite to a direction of movement thereof, and a fourth means for urging said second servo spool toward the middle portion of said feedback link.

2. A remote control system controlled by fluid pressure according to claim 1 wherein said third means for urging said second pilot spool in a direction opposite to a direction of movement thereof is a spring.

3. A remote control system controlled by fluid pressure according to claim 2 wherein said fourth means for urging said second servo spool towards the middle portion of said second feedback link is a spring.

4. A remote control system controlled by fluid pressure according to claim 3 further comprising a roller rotatably mounted to the middle portion of said second feedback link, said roller engaging with said second servo spool.

* * * * *